United States Patent [19]

Glenn

[11] Patent Number: 4,663,904

[45] Date of Patent: May 12, 1987

[54] INSULATING ASSEMBLY FOR WINDOW OPENINGS

[76] Inventor: Dennis L. Glenn, 19675 Draco Dr., Monument, Colo. 80132

[21] Appl. No.: 642,826

[22] Filed: Aug. 20, 1984

[51] Int. Cl.[4] ..... E06B 3/26; E06B 3/32; E06B 3/48

[52] U.S. Cl. ..... 52/202; 52/309.4; 160/92

[58] Field of Search ..... 52/202, 404, 309.4, 52/69, 71; 160/92, 93, 89

[56] References Cited

U.S. PATENT DOCUMENTS

| | | | |
|---|---|---|---|
| 1,252,603 | 1/1918 | Melcher | 160/92 X |
| 1,757,048 | 5/1930 | Janeczko | 160/92 X |
| 1,975,751 | 10/1934 | Burgad | 49/63 |
| 3,020,951 | 2/1962 | Graulich | 160/35 |
| 3,948,308 | 4/1976 | Facey | 52/202 X |
| 4,039,018 | 8/1977 | De Maria | 160/89 |
| 4,081,018 | 3/1978 | Szwartz | 160/113 |
| 4,121,379 | 10/1978 | Everson | 52/202 X |
| 4,199,900 | 4/1980 | Johnson et al. | 49/404 |
| 4,368,594 | 1/1983 | Milam et al. | 52/202 X |
| 4,409,768 | 10/1973 | Boden | 52/309.4 |
| 4,409,768 | 10/1983 | Mitchell | 52/202 |
| 4,486,900 | 12/1984 | Bauch | 52/309.4 X |

*Primary Examiner*—John M. Jillions
*Assistant Examiner*—Lynn M. Sohacki
*Attorney, Agent, or Firm*—Timothy J. Martin

[57] ABSTRACT

A removable, insulated window covering in the form of two insulated, bifolding panels hinged together and mounted over a window are foldable from a position covering the window to a nested storage position above the window. Side and edge seals are provided, as well as folding and latching mechanisms, for moving the panels between the use and storage positions and for retaining the panels in those positions.

21 Claims, 4 Drawing Figures

INSULATING ASSEMBLY FOR WINDOW OPENINGS

BACKGROUND OF THE INVENTION

The present invention relates to insulating structures that are adapted to be inserted in a standard window opening on the interior of a room in which the window opening is situated so as to prevent thermal exchange between the internal environment of the room and the external environment. Thus, thermal exchange is minimized both during cold months, when it is desirable to prevent heat loss from the room, and in the summer, when it is desirable to maintain the room at an inside temperature that is cooler than the outside temperature. The present invention may be employed in conjunction with many existing window structures without inerfering with operation of those structures and which may be readily moved between an operative position in the window opening and a stored position away from the window opening.

In the last few years there has been an inceasing interest in energy conservation, particularly in the area of home heating and cooling. Studies resulting from this increased interest indicate that, for a typical home, a majority of unwanted energy transfer occurs through the windows and their associated window openings. Such losses result both from air leakage around the window and from the relatively poor insulating qualities of the thin layer of glass material used in the window structure. Accordingly, by insulating of a window opening, a large portion of these thermal losses may be eliminated, thus producing substantial energy savings for the home owner.

The value of insulating a window opening has been recognized for some time, although prior art attempts at solving this problem have taken different approaches than that contemplated by the present invention. One example of the prior art is the use of thermo-pane windows where an inner and outer panes of glass are separated by a vacuum. Other attempts have included the development of storm windows which comprise several spaced-apart layers of glass having a dead air space therebetween. Honeycomb blinds having side seals have also been utilized to create isolated air pockets that themally insulate the window opening.

Despite the relative successes of these approaches, there remains a need for a simple yet effective insulating closure for a window opening which closure may be mounted in the room interiorly of the standard window glass. There is a further need for such an insulating cover that is relatively inexpensive to manufacture, pleasing in appearance and which does not require special manufacturing machines. The present invention is directed towards satisfying these remaining needs.

SUMMARY OF THE INVENTION

It is an object of the present invention to provide a new and useful insulating insert that may be inserted into a window opening so as to decrease unwanted thermal transfer through the window opening.

Another object of the present invention is to provide an insulating closure for windows that may be mounted on the interior of a room between the window glass and the room which window closure is relatively inexpensive in manufacture and which is easy to install and operate.

Yet another object of the present invention is to provide a window closure that is easily moveable from an operative position wherein it is inserted into a window opening on the inside of the window glass and to a stored position away from the glass while presenting a pleasing, decorative appearance when it is in the both positions.

In order to accomplish these objectives, the present invention is directed to a window insulator assembly that is adapted to be inserted in a window opening on the interior side of a room. This assembly preferably includes a pair of flat panels formed of an insulating material that are hinged together along facing edges so that they may be placed in a planar position with respect to one another and also pivoted into a folded position. When the panels are in a planar position, they are configured to fit snuggly within the window opening, and edge seals extend around the perimeter of the panels as well as between the hinged adjacent edges. One of the panels is hinged, at its top, to the top sill of the window frame so that the panel may pivot outwardly from the window opening. A lower edge of the top panel has a latch member that will engage a latch mechanism secured to the ceiling of the room. In use, the window insulator assembly may be pivoted away from the window opening in which it nests so that the top panel catch becomes latched by the latch mechanism on the ceiling. A cord assembly is provided to then fold the bottom panel up against the top panel so as to provide minimum storage against the ceiling. When it is desired to re-insert the window insulator into the window opening, the bottom panel is released from the folded position and is bent back so that its upper edge attacks a release lever on the latching mechanism, thereby releasing the panel catch. The whole assembly may then be pivoted downwardly and to be snuggly fit into the window opening in such a manner that the edge seals prevent drafts around its perimeter.

Preferably, each of the panel sections is provided with a rigidifying channel molding extending around the perimeter and the interiorly facing surface of each panel section is adapted to receive a decorative covering so as to present a pleasing appearance. The panel sections may be formed of styrofoam or other insulating material and the window frame may include side ribs and a bottom rib which carry compressible side and bottom seals so that the edge seals are accomplished by a compressive abutment of the panel sections against these ribs. Also, the cord latch may be of a type that permits adjustable operation of the cord so that the lower panel may be retained at any desired angle with respect to the upper panel at an orientation between the planar position and the folded position of the panels. A fastener may be provided on the lower panel so that it engages the catch on the upper panel to retain the panels in a planar position.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
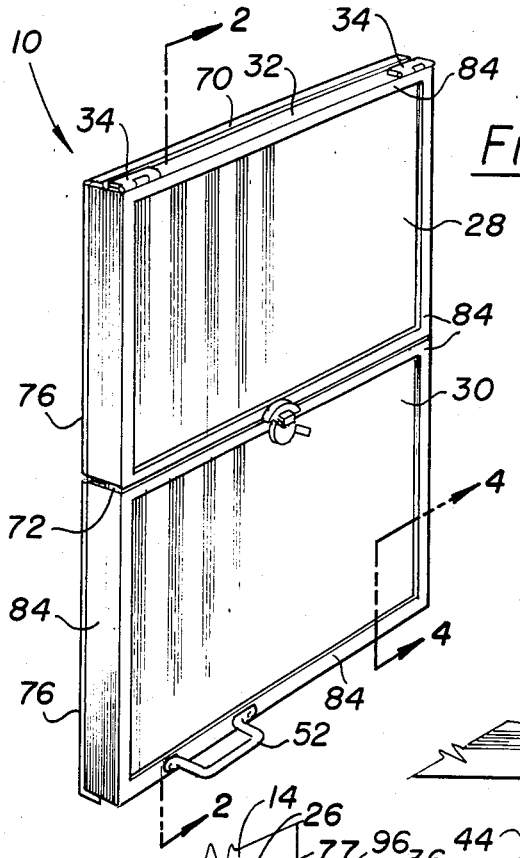
FIG. 1 is a perspective view of the window insulator assembly according to the preferred embodiment of the present invention shown in a planar position for insertion into a window opening.

The present invention relates to window coverings in the form of an insulator assembly that is adapted to be inserted into a window opening in order to prevent thermal transmission therethrough. Thus, the present invention is very useful in preventing unwanted heat entry when it is desired to keep the room cooler than the external environment and also to prevent unwanted heat loss when it is desired to keep the room at a temperature greater than the external environment. This invention is further directed to providing a thermal insulator in an inexpensive manner yet in a way that is aesthetically pleasing.

As can be seen in FIGS. 1–4, window assembly 10 is shown mounted in a window opening 12 that is formed in a wall 14 of a building or other structure. A ceiling 16 extends perpendicularly to wall 14 above window opening 12. Window opening 12 mounts a standard window assembly 18 generally towards the exterior of wall 14. On the interior of wall 14, window opening 12 is surrounded by a window frame including a lower sill 22, a pair of side jambs 24, and an upper sill 26.

Window insulator assembly 10, in the preferred embodiment, is formed of first and second flat panels such as upper panel 28 and lower panel 30 which may be placed in a planar relationship to one another, as is shown in FIG. 1, and inserted into window opening 12. Panels 28 and 30 are sized for close-fitting insertion to opening 12 and thus are configured in the general shape of opening 12. In the figures, this configuration is described with respect to a standard rectangular frame window opening, although the present invention could be employed with other shapes of window openings.

Figure 2:
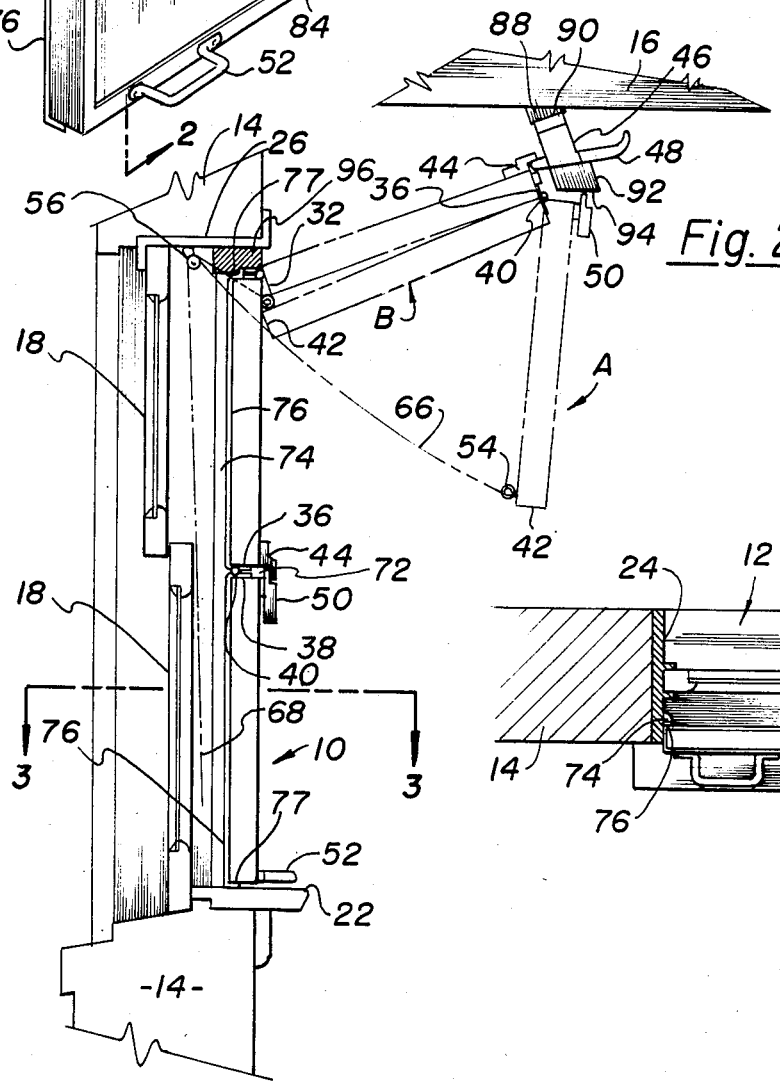
FIG. 2 is a cross-sectional side view of the preferred embodiment of the present invention shown positioned in a window opening.
Figure 3:
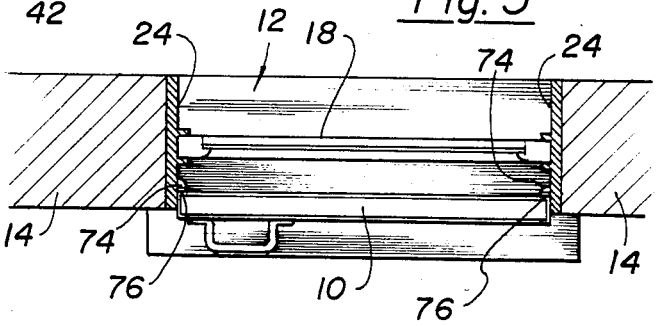
FIG. 3 is a cross-sectional view taken about lines 3—3 of FIG. 2.

Panel 28 has an upper edge 32 that is pivotally attached by hinges 34 to the lower surface of upper sill 26. These hinges allow panel 28 to be pivoted into the interior of the room so that a lower edge 36 of upper panel 28 may be moved out of opening 12 to a position adjacent ceiling 16, as is shown in phantom in FIG. 2. An upper edge 38 of panel 30 is pivotally attached to lower edge 36 by means of hinges 40 so that panel 30 may be folded back alongside panel 28 with a lower edge 42 of panel 30 is alongside edge 32. As is shown in FIGS. 1 and 2, panels 28 and 30 have a common width and thickness, but lower panel 30 is preferably sized to have a longer length than upper panel 28 so that, when panel 30 is folded back alongside panel 28, edge 42 extends into opening 12 past edge 32 of panel 28. In this manner, panel 30 masks hinges 34 so as to present a more pleasing appearance.

It should thus be appreciated that window assembly 10 may be moved between an operative position wherein panels 28 and 30 are substantially planar and inserted in opening 12, as is shown in FIG. 2, to a stored position wherein panel 28 is pivoted toward ceiling 16 and panel 30 is folded back alongside panel 28. To retain panel 28 in the stored position, a latch mechanism interconnects panel 28, along its lower edge 36, to a complimentary latch mechanism positioned on ceiling 16. As is shown in FIGS. 1 and 2, panel 28 includes a catch 44 located at its interior surface and centered along edge 36. Ceiling 16 is provided with a latch 46 that releaseably engages catch 44. Latch 36 includes a release lever 48 that, when operated, releases catch 44 after it has been engaged by latch mechanism 46. Latch 46 may typically be of a type commonly used with storm doors and the like, wherein a release lever 48 is depressed to release a catch received by latch 46. A fastener 50 is secured to lower panel 30 along a central portion of its upper edge 38 with fastener 50 also being constructed to engage catch 44 so as to releaseably retain panels 28 and 30 in a planar orientation with respect to one another. A handle 52 is also mounted on the interior surface of panel 30 along lower edge 42 to facilitate insertion and removal of window insulator assembly 10 into and out of opening 12.

Once upper panel 28 is received by latch 46, it is necessary that lower panel 30 be folded alongside panel 28 so as to prevent lower panel 30 from being an unwanted obstacle depending from ceiling 16, as is shown in FIG. 2. As noted above, panel 30 is pivotal on edge 38 and about adjacent edge 36 so that it may be placed in a folded condition. To facilitate this, a draw cord mechanism is provided. Specifically, a mounting member 54 is attached to the outer surface of lower panel 30, adjacent edge 42. A retaining pulley 56 is mounted at an upper corner of opening 12, with pulley 56 being attached, by an convenient bracket, to upper sill 26. Retaining pulley 56 is of a type commonly used with venetian blinds that permits selective adjustment and gripping of a cord threaded therethrough. To this end, a cord 66 is fastened, at one end, to mounting member 54 and is threaded through pulley 56 so that cord 66 has a free end 68 that hangs alongside one of side jambs 24 in opening 12. By pulling on free end 68 of cord 66, edge 42 of panel 30 is drawn toward edge 32 of panel 28 so that panels 28 and 30 are placed in a folded configuration, as is shown in phantom in FIG. 2.

In order to facilitate a complete seal around and between panels 28 and 30, edge seals, upper and lower seals, and an intermediate seal are provided. Specifically, as is shown in FIG. 1, an upper seal 70, in the form of a strip of compressible material, extends across the entire width of panel 28 on edge 32, and an intermediate seal 72 is mounted on one of facing edges 36 and 38 completely across the common width of panels 28 and 30. When panels 28 and 30 are placed in a planar position, edges 36 and 38 compress seal 72 prevent air from passing between these adjacent edges of panels 28 and 30. Likewise, when panel 28 is placed in a nested position within opening 12, seal 70 is pivoted against top sill 26 to prevent air from passing across the top of panel 28. To complete the sealing of the perimter of panels 28 and 30, side ribs 74 are attached to side jambs 24 and side seals 76, in the form of elongated, compressible strips extend along side edges of each of panels 28 and 30, and include end portions 77 that overlap respective edges 32, 36, 38 and 42. A bottom rib 78 extends across lower seal 22 in a common plane with side ribs 74. Rib 78 has an outwardly facing surface that receives an elongated, compressible sealing strip 80. When panels 28 and 30 are in a planar position and are inserted into close-fitting engagement with opening 12, the side seals 76 compress against ribs 74 and a lower edge portion of lower panel 30 abuts and compresses sealing strip 80 so that, in conjunction with upper strip 70, completely seals the perimeter of this panel assembly. Instead of placing seals 76 on panels 28 and 30, seals 76 could be directly mounted to ribs 74 in a manner similar to that described for seal 80.

Figure 4:
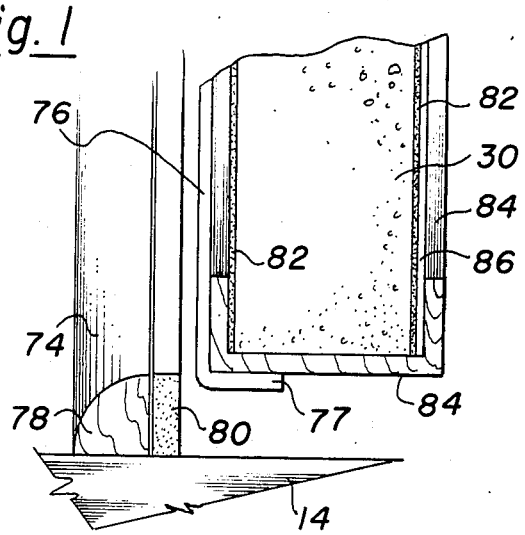
FIG. 4 is a cross-sectional view taken about lines 4—4 of FIG. 1 of the corner detail shown in conjunction with the window opening.

Panels 28 and 30 may be formed of any convenient material, but, in the preferred form of this invention, a light-weight, styrofoam material is selected. The front and back surfaces of each of panels 28 and 30 are provided with a stiffening or backing material 82, shown with respect to panel 30 in FIG. 4, which may be in the form of a light-weight cardboard, that helps strengthen styrofoam panels 28 and 30 from accidental breakage yet which maintains their lightweight construction. To further strengthen panels 28 and 30, as is shown in FIGS. 1 and 4, each of panels 28 and 30 include a channel-shaped molding that extends completely around their respective perimeters. These moldings may be formed of a wood or plastic material, but it is preferred that each of molding pieces 84 be formed of a non-thermally conducting substance. Further to enhance the appearance of panels 28 and 30 from the interior of the room in which window opening 12 if formed, a decorative material 86, such as a fabric, wall paper or the like, may be placed over desired backings 82. In the alternative, backings 82 could be painted in any desired manner so as to provide a more aesthetically pleasing appearance.

The operation of window insulator assembly 10 can now be more fully appreciated and understood. When it is desired to move insulating assembly 10 out of an insulating relationship with opening 12, fastener 50 is rotated so that it releases catch 44, and the user pulls handle 52 so as to remove panels 28 and 30 from opening 12. This movement pivots panel 28 about top sill 26 on hinges 34 so that edge 36 moves toward ceiling 16. Simultaneously, panel 30 is maintained in a vertical orientation, as is shown at A in FIG. 2, so that panels 28 and 30 pivot with respect to one another. This movement is continued until catch 44 engages latch 46 and is retained thereby. Handle 52 may then be released and the user may pull free end 68 of cord 66 so that edge 42 is drawn toward edge 32 and is retained in the folded position shown at B in FIG. 2, by manipulating retaining pulley 56 as is known in the art. When it is desired to release panels 28 and 30 from the folded or stored position, free end 68 is again manipulated to release cord 66 from retaining pulley 62 so that panel 30 is again moved generally perpendicular to a vertical position perpendicular to ceiling 16. In order to release panel 28, the user pulls handle 52 outwardly away from wall 14 so that edge 38 of panel 30 attacks release lever 48, as is shown in FIG. 2, so that, when lever 48 is moved a sufficient distance, latch 46 releases catch 44. Panels 28 and 30 are then pivoted with respect to one another while panel 28 is pivoted on hinges 34 so that the panels move into abutment with ribs 74 and 78. This compresses upper seal 70, intermediate seal 72, side seals 76 and bottom seal 80 so that a relatively air-tight structure is provided.

From the foregoing, it should be appreciated that latch 46 and retaining handle 48 must be positioned so that edge 38 may attack release lever 48. To this end, as is shown in FIG. 2, latch 46 is mounted on a block 88 that has an inclined surface 90 that is formed at an angle with respect to ceiling 16 which is approximately the same as the angle panel 28 makes with ceiling 16 when catch 44 is received by latch 46. To permit edge 38 to more conveniently attack release lever 48, a spacer block 92 may be mounted on release lever 48. Spacer block 92 has an inclined surface 94 that is generally parallel to ceiling 16 and is sized so that edge 38 will attack inclined surface 94 upon only a relatively small outward movement of panel 30 outwardly into the room. To further enhance this structure, upper edge 32 of panel 38 may be attached to upper sill 26 by means of a mounting member 96, such as a flat board, which extends across top sill 26 and is attached thereto. Hinges 34 and pulley 56 are then attached to mounting member 96. In this manner, window insulator assembly 10, with the exception of side ribs 74 and bottom rib 78 may be completely removed from opening 12 simply by removing mounting member 96.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An insulating assembly for use in a window opening in a room having a wall in which said opening is formed wherein said window opening includes a top sill, a bottom sill and a pair of side jambs to define the window opening therebetween, and a ceiling above said opening, comprising a first flat panel having a first top edge and a first bottom edge and a second flat panel having a second top edge and a second bottom edge, said first and second panels constructed of an insulating material and hinge means allowing the panels to be hinged together along said first bottom edge and said second top edge whereby said first and second panels are pivotable between a substantially planar orientation and a folded orientation with said second bottom edge adjacent said first top edge, said second bottom edge freely movable out of the window opening, and said first and second panels sized for close-fitting insertion into said opening when in said planar orientation, said first panel hinged along said first top edge to said top sill whereby said first panel is pivotable between a first position in said opening and a second position wherein said first bottom edge is adjacent said ceiling and wherein said hinge means allows the second panel to be suspended from the first bottom edge with the second botom edge moved out of said window opening, latch means for releaseably retaining said panels in said second postion and retaining means for releaseably retaining said first and second panels in said folded orientation.

2. An insulating assembly according to claim 1, including an upper sealing strip between said first top edge and said top sill and a middle sealing strip between said first bottom edge and said second top edge.

3. An insulating assembly according to claim 2, including a lower sealing strip operative to seal said second panel along said bottom sill and a pair of side sealing strips operative to seal said first and second panels along said side jambs.

4. An insulating assembly according to claim 3 wherein said upper, middle, lower and side sealing strips are constructed of a compressible material.

5. An insulating assembly according to claim 3, including a side rib secured to each of said jambs and a bottom rib secured to said bottom sill, said side sealing strips being mounted to side edges of said first and second panels facing said ribs, said lower sealing strips mounted to said bottom rib facing said room whereby said ribs abut said side sealing strips and said lower panel abuts said lower sealing strip to substantially seal the perimeter of said opening when the panels are inserted into said opening.

6. An insulator assembly according to claim 1 wherein said latch means includes a catch on said first panel adjacent said first bottom edge and a latch mechanism secured to said ceiling at a location to engage said catch when said first panel is in said second position.

7. An insulator assembly according to claim 6 wherein said latch mechanism includes a release lever oriented to be attacked by said second top edge when said second panel is moved toward said planar orientation while said catch is engaged whereby said release lever is operated to release said catch.

8. An insulator assembly according to claim 6 including a fastener means on said second panel adjacent said second top edge for engaging said catch to retain said first and second panels in said planar orientation.

9. An insulator assembly according to claim 1 wherein said retaining means includes a cord attached to said second panel adjacent said bottom edge and a cord latch mounted to said window frame and operative to receive said cord for retaining said second panel in at any desired angle with respect to said first panel between said planar orientation and said folded orientation.

10. An insulator assembly according to claim 1 wherein said first and second panels are constructed of styrofoam.

11. An insulator assembly according to claim 10, including first backing material on a front face of each of said first and second panels facing said room and second backing material on a back face of each of said first and second panels facing away from said room when said first and second panels are inserted into said opening.

12. An insulator assembly according to claim 10 wherein said first and second panels are each surrounded by a framework of channel pieces receiving respective edge portions thereof.

13. An insulator assembly according to claim 12 wherein said first and second panels each have a face surface facing said room when said first and second panels are in said opening and including a decorative covering on each of said face surfaces.

14. An insulator assembly according to claim 1, including a mounting member releaseably secured to said top sill, said first top edge being hinged to said mounting member whereby removal of said mounting member permits detachment of said first and second panels from said window frame.

15. An insulator assembly according to claim 1 wherein said second panel has a length greater than the length of said first panel whereby said second bottom edge extends into said opening when said first and second panels are in said folded orientation and said first panel is in said second position and operative to mask the connection of said first top edge of said top sill.

16. An insulator assembly for use in a window opening formed in a wall at a location below a ceiling surface generally perpendicular to and above the wall and having a window frame, comprising:

first and second bi-fold panels hinged together along a pair of adjacent edges and relatively pivotal between an operative position wherein said bi-fold panels are generally planar and a stored position wherein said bi-fold panels are folded against one another, said bi-fold panels being constructed of insulating material and configured for close-fitting insertion into said opening when in the operative position, a first one of said bi-fold panels pivotally secured to said window frame along a hinged edge opposite its said adjacent edge;

edge seals extending around the perimeter of said bi-fold panels when they are in the operative position and inserted in said opening;

an intermediate seal between said adjacent edges;

releasable latch mechanism mounted on said ceiling surface and operative to engage a catch mounted on said first bi-fold panel adjacent its said adjacent edge and to retain said first bi-fold panel in an orientation out of said opening and generally against said ceiling surface, said latch mechanism including a release lever oriented to be attacked by the adjacent edge of the second one of said bi-fold panels when said first bi-fold panel is in the stored position and the second bi-fold panel is moved toward a planar orientation with respect to the first bi-fold panel whereby said latch mechanism is operated to release said catch; and retaining means for releaseably retaining said bi-fold panels in said stored position.

17. An insulator assembly according to claim 16 wherein said window frame has a bottom sill, a top sill and a pair of side jambs, and including a pair of side ribs mounted on said side jambs and a bottom rib mounted on said bottom sill, each having surfaces facing respective edge portions of said bi-fold panels around its perimeter, said edge seals including strips of compressible material mounted between said rib surfaces and said edge portions.

18. An insulator assembly according to claim 17 wherein said strips are mounted to said side ribs and said bottom rib.

19. An insulator assembly according to claim 17 wherein said strips are mounted to said edge portions.

20. An insulator assembly according to claim 17 including a mounting member removably secured to said window frame, said first bi-fold panel being pivotally secured to said mounting member.

21. An insulating assembly for use in a window opening in a room having a wall in which said opening is formed wherein said window opening includes a top sill, a bottom sill and a pair of side jambs, and a ceiling above said opening, comprising a first flat panel having a first top edge and a first bottom edge and a second flat panel having a second top edge and a second bottom edge, said first and second panels constructed of an insulating material and hinge means allowing the panels to be hinged together along said first bottom edge and said second top edge whereby said first and second panels are pivotable between a substantially planar orientation and a folded orientation with said second bottom edge adjacent said first top edge, said first and second panels sized for close-fitting insertion into said opening when in said planar orientation, said first panel hinged along said first top edge to said top sill whereby said first panel is pivotable between a first position in said opening and a second position wherein said first bottom edge is adjacent said ceiling, latch means for releaseably retaining said first panel in said second with the position hinge means allowing the second panel to be freely suspended from said first panel with the second bottom edge moved out of the window opening and retaining means for releaseably retaining said first and second panels in said folded orientation, said latch means including a catch on said first panel adjacent said first bottom edge and a latch mechanism secured to said ceiling at a location to engage said catch when said first panel is in said second position.

* * * * *